US007931564B1

(12) United States Patent
Wu

(10) Patent No.: US 7,931,564 B1
(45) Date of Patent: Apr. 26, 2011

(54) ASSEMBLED ROCK CLIMBING DEVICE

(76) Inventor: Yu-Feng Wu, Taichung (TW)

( * ) Notice: Subject to any disclaimer, the term of this patent is extended or adjusted under 35 U.S.C. 154(b) by 0 days.

(21) Appl. No.: 12/623,397

(22) Filed: Nov. 21, 2009

(51) Int. Cl.
*A63B 21/00* (2006.01)

(52) U.S. Cl. ..... 482/37; 482/35; 482/36

(58) Field of Classification Search ..... 482/35–37
See application file for complete search history.

(56) References Cited

U.S. PATENT DOCUMENTS 5,254,058 A * 10/1993 Savigny ..... 482/37
7,572,207 B2 * 8/2009 Postma ..... 482/37

FOREIGN PATENT DOCUMENTS

DE EP 0 384 439 * 2/1989

* cited by examiner

*Primary Examiner* — Jerome W Donnelly
(74) *Attorney, Agent, or Firm* — Wang Law Firm; Li K. Wang

(57) ABSTRACT

An assembly rock climbing device having a rock climbing body comprised of several three-dimensional assembly blocks. Each of the assembly blocks has at least one surface and at least one assembly surface to be connected with adjacent assembly blocks. The assembly blocks are connected via their assembly surfaces to form the rock climbing body. The surfaces of the assembly blocks combine to form at least one climbing surface for users to climb. Rocks are disposed on the climbing surface for users to hold.

4 Claims, 8 Drawing Sheets

ASSEMBLED ROCK CLIMBING DEVICE

BACKGROUND OF THE INVENTION

1. Field of Invention

The invention relates to a rock climbing device and, in particular, to a rock climbing device that put several assembling blocks together to form a rock climbing body.

2. Related Art

For people living in a city, it usually takes a lot of time to travel to a natural rocking climbing place. Moreover, the exercise is easily affected by weather. Therefore, artificial rock climbing places have been invented. Whether it is indoor or outdoor, such an artificial rock climbing place is more accessible and safer. So the rock climbing place brings rock climbing from the wild into the city for more people to enjoy the fun.

As shown in FIG. 8, a conventional rock climbing device consists of several plates 51 assembled together to form a climbing wall 52. When the climbing wall 52 is put indoor, it is directly fixed onto the original wall. When it is assembled outdoor, there is no wall to support. Therefore, the back of the climbing wall 52 has to be supported by a supporting frame 6. The front surface of the plates 51 is then made like natural rocks. That is, several rocks 7 are installed to predetermined positions at predetermined distances on the plates 51.

However, the conventional rock climbing device has its shortcomings. As said before, when it is assembled indoor, it has to lie against a fixed and sturdy wall. If there is no such a wall, then the rock climbing device cannot be assembled properly. When it is used outdoor, there is no wall. The use of a supporting frame complicates the structure and assembly. Moreover, the shape of the climbing wall is fixed. It is therefore not easy for one to change the overall shape or modify the difficulty. The device cannot be moved to another place to use. It is thus the objective of the invention to provide a more convenient rock climbing device.

SUMMARY OF THE INVENTION

An objective of the invention is to provide an assembled rock climbing device to solve the aforementioned problems. By combining several assembly blocks as the base of the rock climbing device, the rock climbing body can be formed into an L shape, triangle, square, or other more creative shape. It can have many different shapes and one can create freely. Moreover, they can be assembled to have a protruding or recess climbing surface, in order to provide more fun and different difficulty levels.

One feature of the invention is that the disclosed rock climbing device comprises several assembly blocks without leaning against a wall or a supporting frame. Therefore, the assembly is not restricted by the location. It is therefore more convenient.

Another feature of the invention is that each of the assembly blocks is designed to have a Lego structure so that they can be connected and separated. Therefore, the user can change the location of the rock climbing device or put them away easily.

To achieve the above-mentioned objective, the invention includes a rock climbing body consisting of a plurality of three-dimensional assembly blocks, each of which has at least one surface and at least one assembly surface to combine with adjacent assembly blocks. The surface and the assembly surface connect to form the assembly block. The assembly blocks are then combined using the assembly surfaces to form at least one climbing surface. The climbing surface has several rocks for grabbing.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
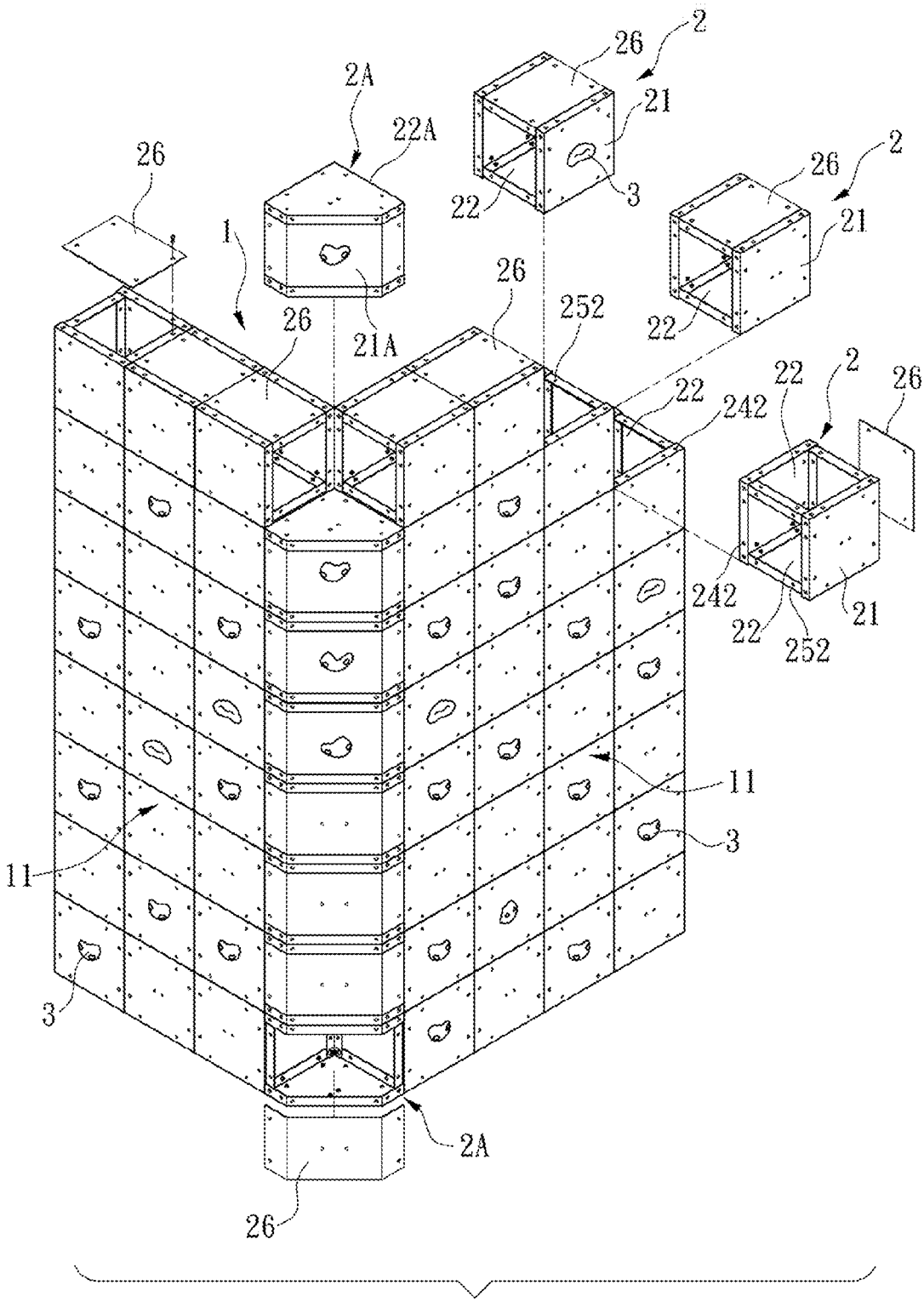
FIG. 1 is a three-dimensional view of the disclosed rock climbing body.

The present invention will be apparent from the following detailed description, which proceeds with reference to the accompanying drawings, wherein the same references relate to the same elements.

Please refer to FIGS. 1 to 7 for embodiments of the invention. The invention provides an assembly rock climbing device that has a rock climbing body 1 consisting of many three-dimensional assembly blocks 2, each of which has at least one surface 21 and at least one assembly surface 22 for connection with adjacent assembly blocks 2. The surface 21 and the assembly surface 22 connect to form the assembly block 2. The rock climbing body 1 comprises several assembly blocks 2 connected by their assembly surface 22. Moreover, the rock climbing body 1 can be combined from the assembly blocks 2 to have different shapes and structures. The rock climbing body 1 has a large-area climbing surface 11 for the user to climb by connecting the surfaces 21 of the assembly blocks 2. The climbing surface 11 has several rocks 3 for grabbing.

Figure 2:
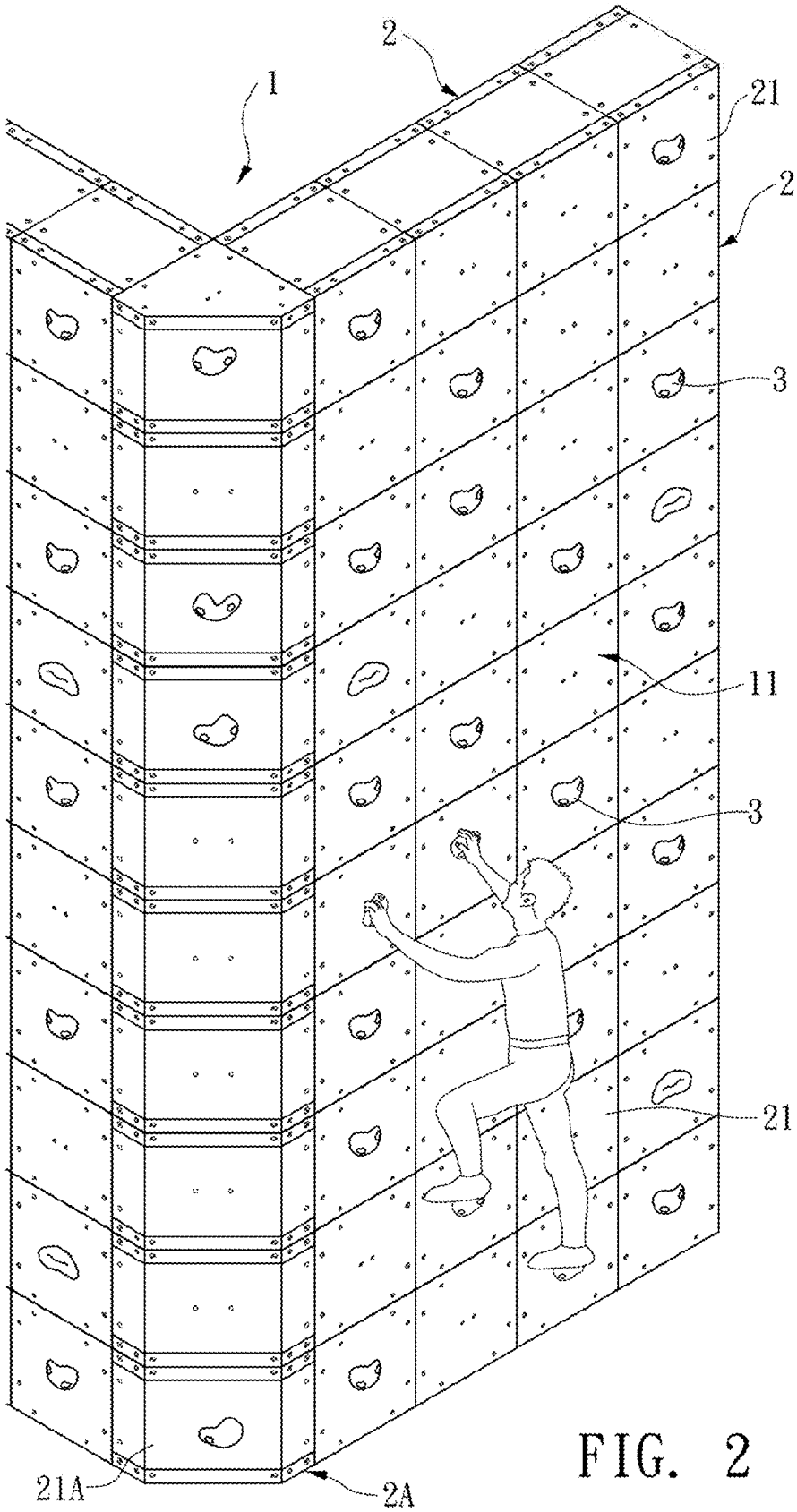
FIG. 2 is a schematic view of the disclosed rock climbing body with a person climbing thereon.

In an embodiment shown in FIGS. 1 and 2, an L-shape rock climbing body 1 is formed by combining the assembly surfaces 22 of several cubic assembly blocks 2 and the assembly surfaces 22A of several triangular assembly blocks 2A. Moreover, the surfaces 21, 21A of the assembly blocks 2, 2A are connected to form a large-area climbing surface 11 on the rock climbing body 1. The user can thus rock-climb on the rocks provided on the large-area climbing surface 11.

Figure 3:
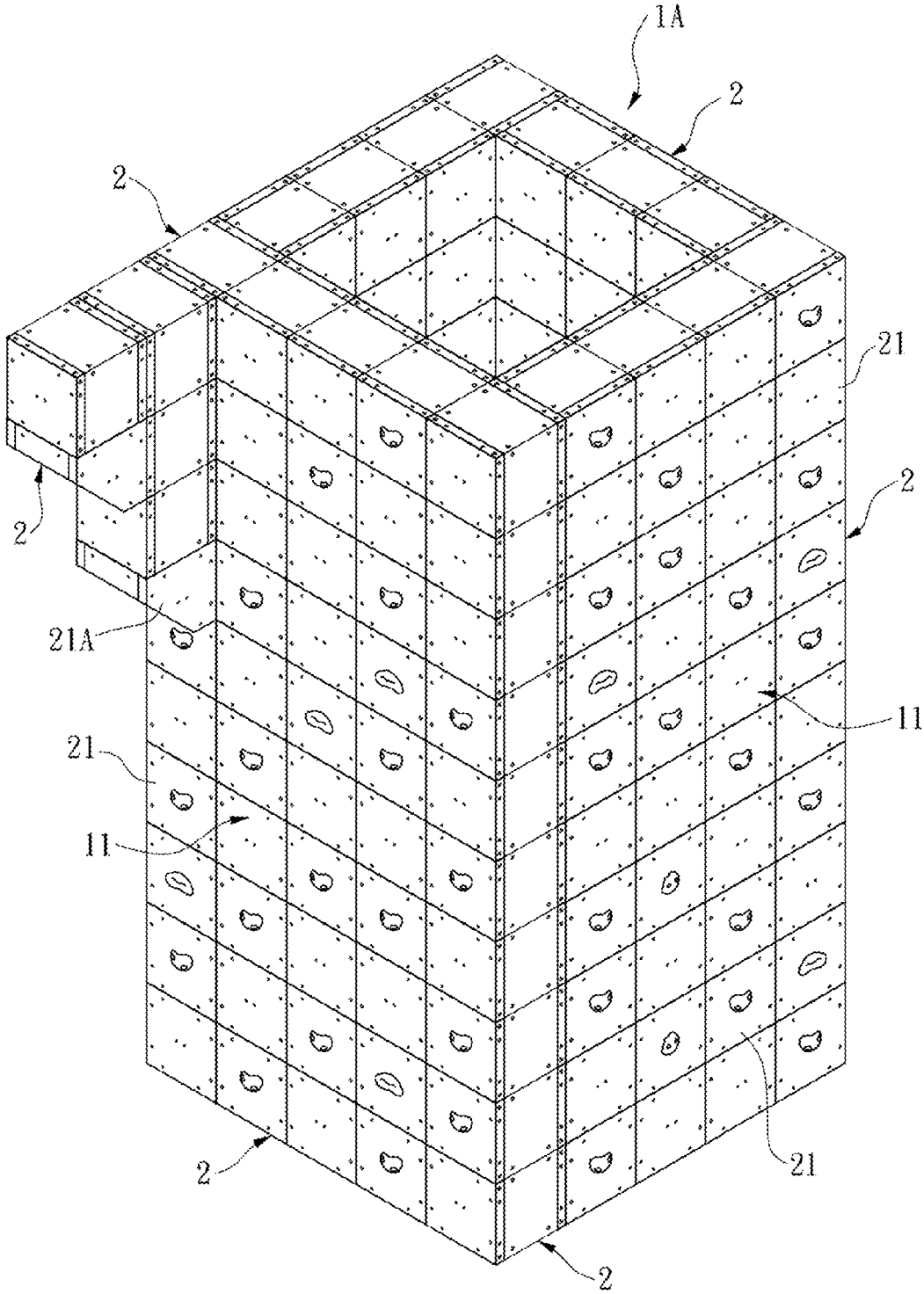
FIG. 3 is a schematic view of the disclosed rock climbing body in another shape.
Figure 4:
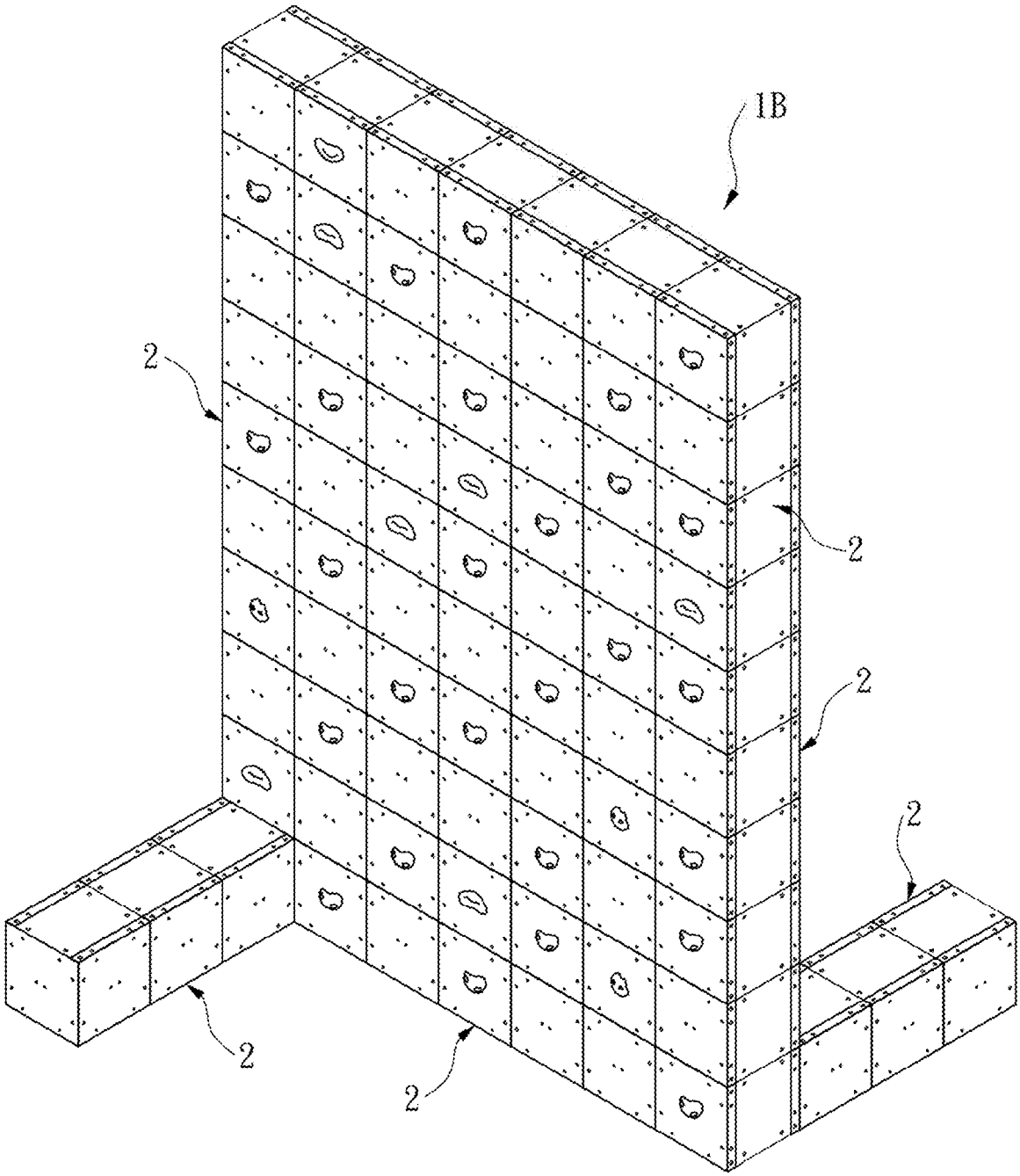
FIG. 4 is a schematic view of the disclosed rock climbing body in yet another shape.

Since the rock climbing body is composed of many assembly blocks, it can be made into an arbitrary shape. As shown in FIG. 3, any cubic assembly blocks 2 and many triangular assembly blocks 2A are combined to form the rock climbing body 1A in the shape of a hollow square pillar. The rock climbing body 1 has a large-area rectangular climbing surface 11 formed by connecting the surfaces 21, 21A of the assembly blocks 2, 2A. So it allows several users to climb at the same time. Moreover, one may use only several cubic assembly blocks 2 to form a rock climbing body 1B standing on the ground, as shown in FIG. 4. Of course, there are many possible shapes for the rock climbing body 1. The invention is not limited to the above-mentioned examples.

Figure 5:
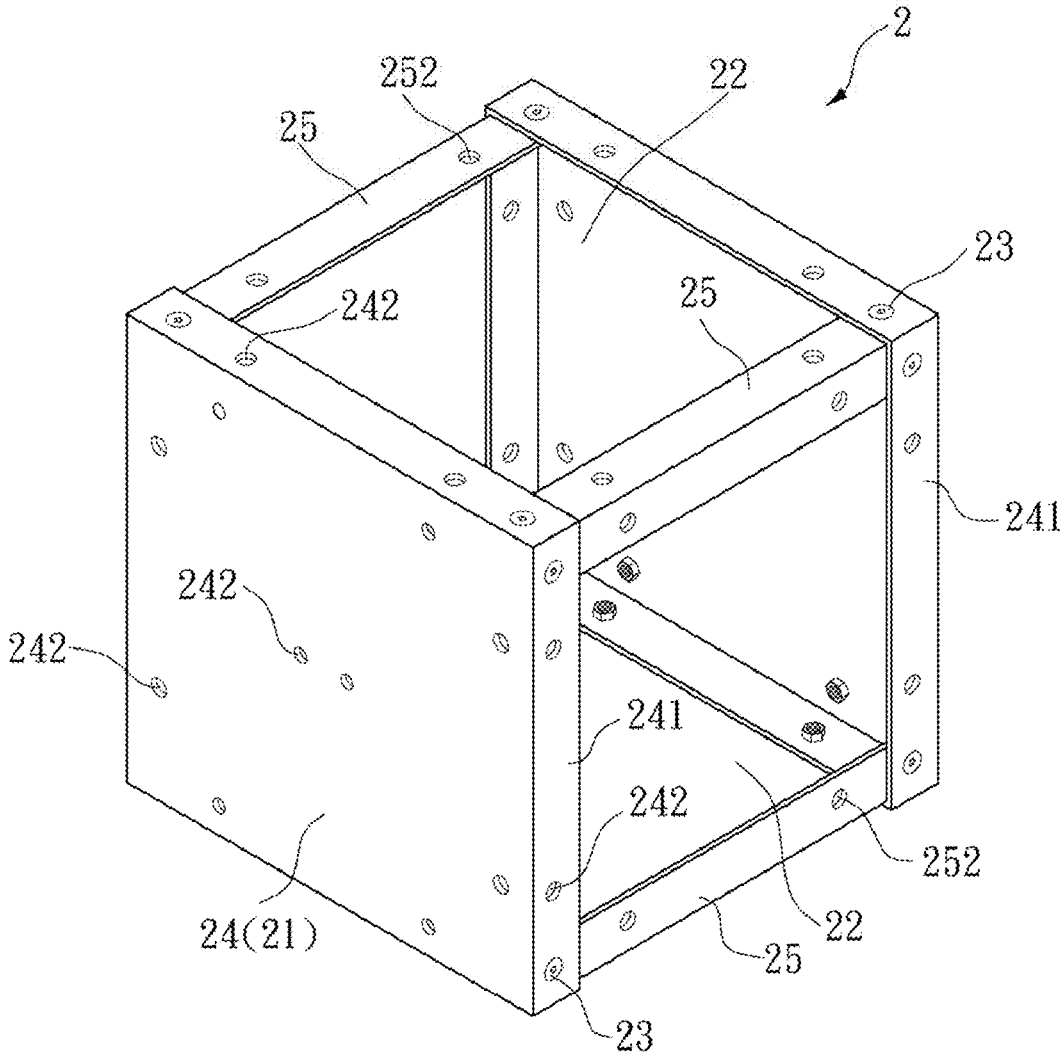
FIG. 5 is a three-dimensional view of the disclosed assembly block.
Figure 6:
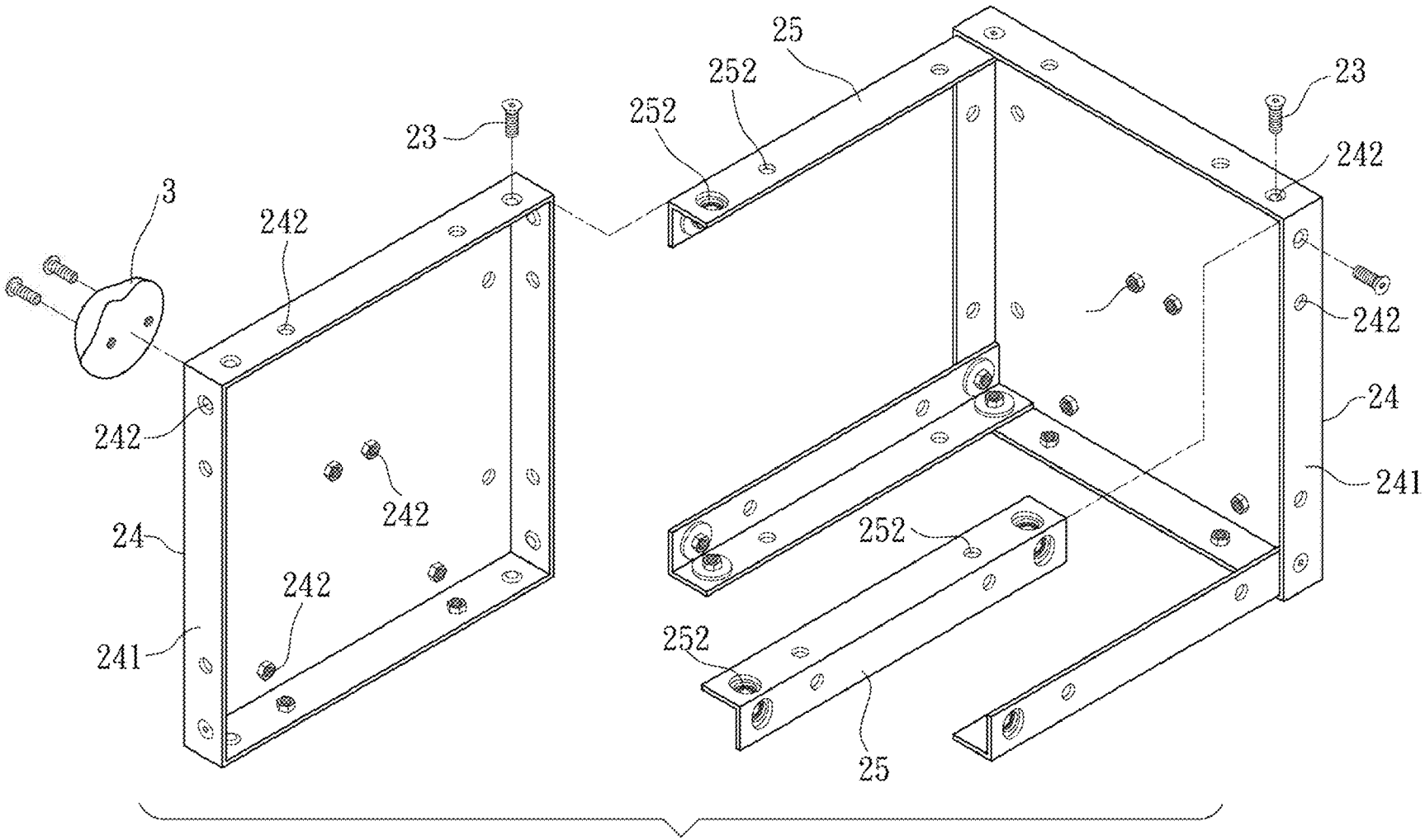
FIG. 6 is a three-dimensional exploded view of the disclosed assembly block.
Figure 7:
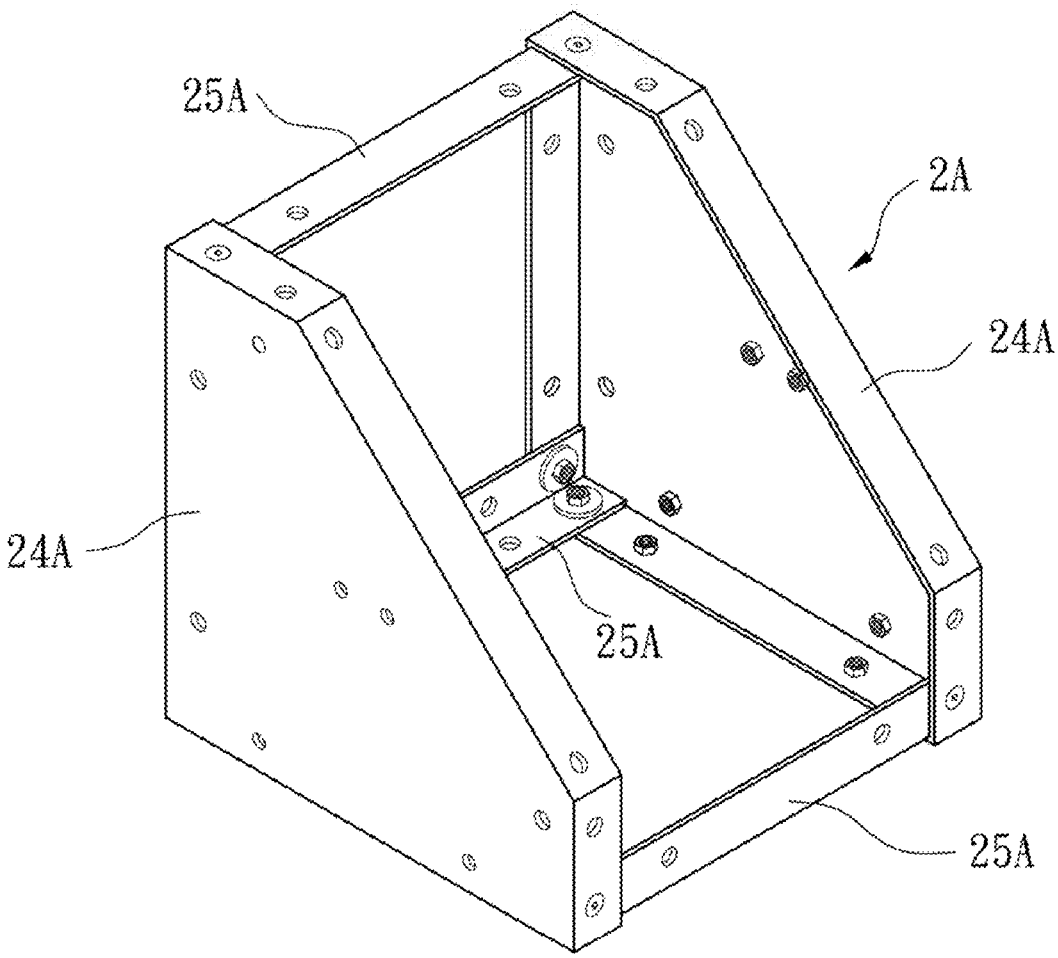
FIG. 7 is a three-dimensional view of the disclosed assembly block in another shape.
Figure 8:
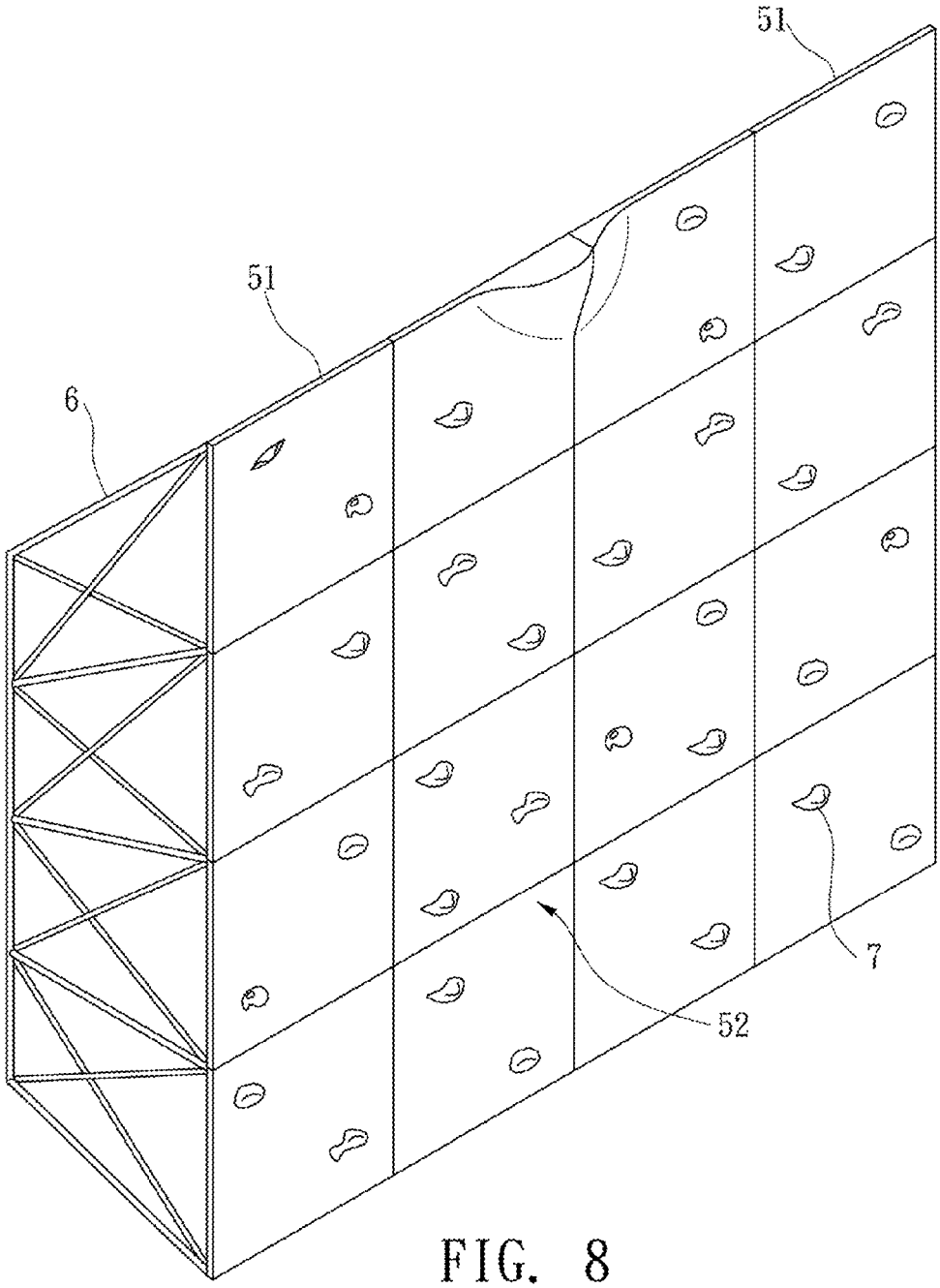
FIG. 8 PRIOR ART
FIG. 8 shows a conventional rock climbing device.

Since the rock climbing body is composed of many assembly blocks, in order to combine and fix the assembly blocks and save materials, the assembly block can be designed to have the structures shown in FIGS. 5 to 7. They are mainly a hollow structure composed of two plates 24 and several beams 25. Each of the plates 24 is extended with a protruding edge 241 at the edges. Each of the plates 24 and the protruding edges 241 has several assembly holes 242. Each of the beams 25 is an L-shaped body and has several combining holes 252. Several fixing elements 23, the combining holes 252 of the beams 25, and the assembly holes 242 on the protruding edges 241 of the plate 24 fix both ends of each of the beams 25 to the inner side surfaces of the protruding edges 241 of the two plates 24, rending a hollow structure. The outer side surface of at least one plate 24 of the assembly block 2 becomes the surface 21. Rocks 3 are disposed using the assembly holes 242 of the plate 24. The hollow surface surrounded by the beams 25 becomes the assembly surface 22. The assembly blocks are then connected via the combining holes 252 on the beams 25 of one assembly bock 2 with the assembly surface 22 of the other assembly block 2.

The above-mentioned plate 24 is a square plate. Therefore, two of the plates 24 and four of the beams 25 combine to form a cubic assembly block 2, as shown in FIG. 5. In another embodiment of the assembly block, the plate 24A is a triangular plate. Therefore, two of the plates 24A and three beams 25A are combined to form a triangular assembly block 2A, as shown in FIG. 7. Of course, there are many possible shapes for the disclosed assembly block. The invention is not limited to the above-mentioned examples.

During assembly, as shown in FIG. 1, many assembly blocks 2, 2A are stacked horizontally or vertically in a way that the assembly surfaces 22, 22A of the assembly blocks 2, 2A are attached to each other. The assembly holes 242 and the combining holes 252 are locked together, so that these assembly blocks 2, 2A are stacked according to the user into a rock climbing body 1. The outer surfaces (surfaces 21) of the plates 24, 24A of the assembly blocks 2, 2A thus become a large-area flat surface after the combination. This is the above-mentioned climbing surface 11. Rocks 3 are then disposed at appropriate places on the climbing surface 11 using the assembly holes 242 on the plates 24, 24A. The user can hold or stand on the rocks during rock climbing.

After the rock climbing body 1 is assembled, a panel 26 can be used to cover the hollow side of the assembly blocks 2, 2A for the sake of safety and beauty, as shown in FIG. 1.

It is easy to, see the main features of the invention from the above description. The use of assembly blocks can modulize the assembly. One can even change the structure during of after the assembly. Therefore, it is possible to render different shapes using one's creativity. Protruding or recess climbing surfaces can be obtained through appropriate assembly to provide more fun and difficulty levels.

Since the rock climbing device is composed of many assembly blocks and does not require the support of a wall or supporting frame, the assembly is not restricted by location. It is very convenient. Beside, as the rock climbing device comprises many assembly blocks, each of which can be combined together or separated apart, it is thus fairly easy to change the location or put them away.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An assembly rock climbing device having a rock climbing body comprised of a plurality of three-dimensional assembly blocks connected together, wherein each of the assembly blocks has at least one surface and at least one assembly surface to be connected with adjacent assembly blocks, the surface and the assembly surface connect to form the assembly block, the assembly blocks are connected via the assembly surfaces, the assembly blocks are combined to form different shapes and structures, the surfaces of the assembly blocks form at least one large-area climbing surface for users to climb after the connection, and there are a plurality of rocks disposed on the climbing surface, wherein the assembly block is a hollow structure formed with two plates and several beams, the edge of each of the plates is extended with a protruding edge, each of the plates and the protruding edge are formed with several assembly holes, each of the beams is an L-shaped plate formed with several combining holes, fixing elements are used to connect the combining holes of the beams and the assembly holes on the protruding edge of the plate, both ends of each of the beams are locked to the inner side surface of the protruding edge of the two plates to form a hollow structure, the outer side surface of at least one plate of the assembly block becomes the surface, rocks are disposed on the assembly holes on the plate, the hollow surface surrounded by the beams becomes the assembly surface, and the connection with the assembly surface of another assembly is done via the combining holes on the beams.

2. The assembly rock climbing device of claim 1, wherein the surface of each of the assembly blocks has several assembly holes for the disposition of the rocks.

3. The assembly rock climbing device of claim 1, wherein the plate of the assembly block is a square plate and the assembly block is a cubic structure with two plates and four beams.

4. The assembly rock climbing device of claim 1, wherein the plate of the assembly block is a triangular plate and the assembly block is a three-dimensional triangular structure with two plates and three beams.

* * * * *